US005283408A

United States Patent [19]

Chen

[11] Patent Number: 5,283,408

[45] Date of Patent: Feb. 1, 1994

[54] STRUCTURE OF KEY SWITCH

[75] Inventor: S. H. Chen, Tao Yuan Hsien, Taiwan

[73] Assignee: Silitek Corporation, Taipei, Taiwan

[21] Appl. No.: 924,710

[22] Filed: Aug. 4, 1992

[51] Int. Cl.[5] ..... H01H 13/50

[52] U.S. Cl. ..... 200/345; 200/520; 200/530

[58] Field of Search ..... 200/341, 342, 343, 344, 200/345, 329, 520, 521, 530, 534, 517, 513; 4/255.11, 255.12

[56] References Cited

U.S. PATENT DOCUMENTS 1,154,055 9/1915 Reeves ..... 4/255.12
2,203,185 6/1940 Walus ..... 4/255.11
4,418,257 11/1983 Muller et al. ..... 200/516 X
4,518,833 5/1985 Watkins ..... 200/329 X
4,556,769 12/1985 Inaba ..... 200/345
4,602,138 7/1986 Berutto et al. ..... 200/342 X

*Primary Examiner*—Henry J. Recla
*Assistant Examiner*—Glenn T. Barrett
*Attorney, Agent, or Firm*—Lowe, Price, LeBlanc & Becker

[57] ABSTRACT

A key switch includes a rectangular key cap having a unitary, hollow, rectangular plunger inserted into a rectangular hole on a key base and pressed to squeeze a rubber tone causing a conductor to electrically connect a contact on the printed circuit board of a keyboard, wherein the rectangular plunger has four circular rails on the four corners thereof along its length respectively inserted in four circular grooves on the rectangular guide slot of the key base for stable movement, and two smoothly curved, hooked spring plates releasably hooked with two opposite hooked portions on the key base for positioning.

2 Claims, 7 Drawing Sheets

STRUCTURE OF KEY SWITCH

BACKGROUND OF THE INVENTION

The present invention relates to a key switch consisted of a key cap, a key base and a rubber tone in which the key cap has a unitary, hollow, rectangular plunger inserted into a hole on the key base and pressed to squeeze the rubber tone in producing a respective pulse signal.

FIG. 1 illustrates a key switch according to the prior art, which is generally comprised of a key cap (1*a*), a rectangular plunger (2*a*), a key base (3*a*), and a rubber tone (4*a*). Pressing the key cap (1*a*) causes the rectangular plunger (2*a*) to slide downwards in a rectangular hole on the key base (3*a*), and therefore the rubber tone (4*a*) is squeezed to drive a conductor to contact a contact on the printed circuit board below. Because the key cap (1*a*), the rectangular plunger (2*a*), the key base (3*a*) and the rubber tone (4*a*) are separately made, the assembly process of this structure of key switch is complicated, and the total height of this structure of key switch can not be greatly reduced. Because the rectangular plunger (2*a*) has four sides respectively closely attached to the inside surface of the key base (3*a*), moving the rectangular plunger (2*a*) in the rectangular hole on the key base (3*a*) causes a great frictional force to occur. Furthermore, the outward bottom flange (21*a*) of the rectangular plunger (2) will be forced to strike against the inward top flange (31*a*) of the key base (3*a*) in producing a big noise as the rectangular plunger (2*a*) is moved back to its original position by the rubber tone (4*a*).

SUMMARY OF THE INVENTION

The present invention eliminates the aforesaid problems. According to one aspect of the present invention, there is provided a key switch which comprises a rectangular key cap having a unitary, hollow, rectangular plunger inserted into a rectangular hole on a key base and pressed to squeeze a rubber tone causing a conductor to electrically connect a contact on the printed circuit board of a keyboard. Because the rectangular plunger and the rectangular key cap are integrally made into a unitary piece, the assembly process of the key switch is simplified, and the total height of the key switch is greatly reduced. According to another aspect of the present invention, the rectangular plunger has four circular rails on the four corners thereof along its length respectively inserted in four circular grooves on the rectangular guide slot of the key base for stable movement, and two smoothly curved, hooked spring plates releasably hooked with two opposite hooked portions on the key base for positioning. This arrangement stabilizes the movement of the rectangular plunger in the rectangular slot on the key base and greatly reduces the noise level during the operation of the key switch.

DETAILED DESCRIPTION OF THE PREFERRED EMBODIMENT

Figure 1:
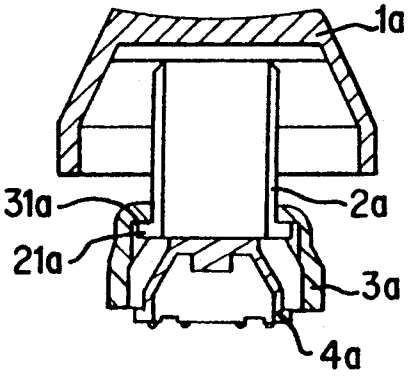
FIG. 1 PRIOR ART
FIG. 1 illustrates the structure of a key switch according to the prior art.
Figure 2:
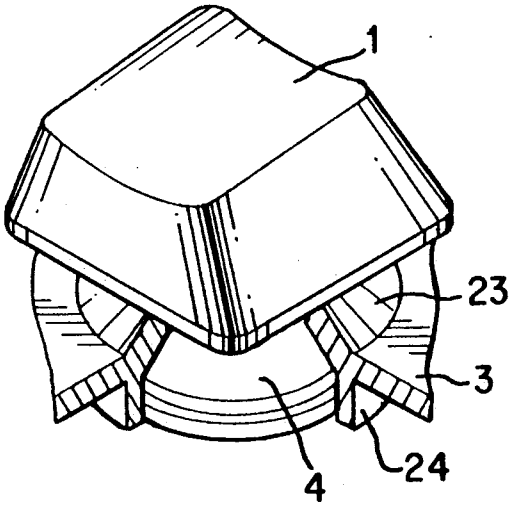
FIG. 2 illustrates the outer appearance of a key switch embodying the present invention.
Figure 3:
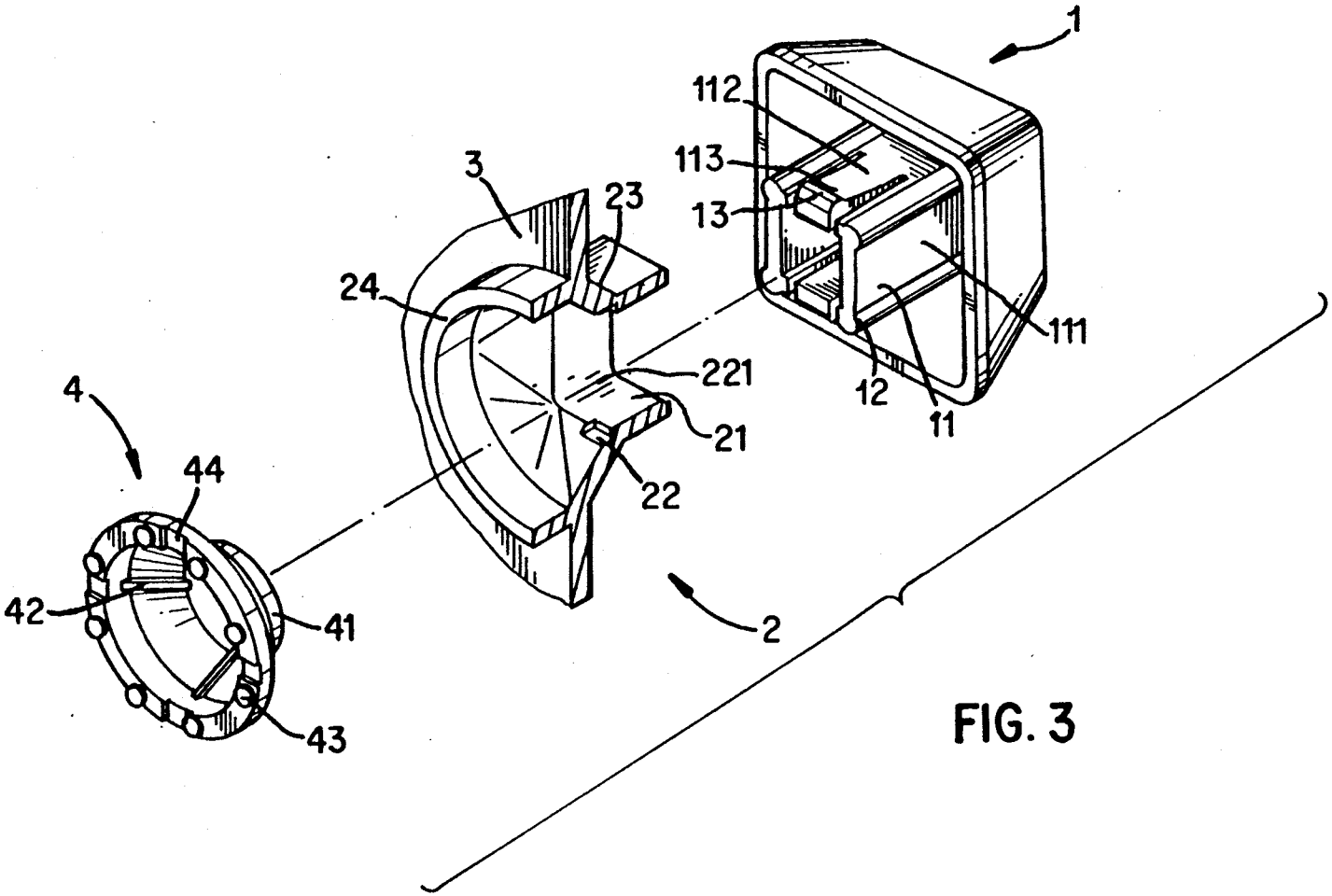
FIG. 3 is an exploded view of the key switch of FIG. 2.

Referring to FIGS. 2 and 3, a key switch as constructed in accordance is generally comprised of a rectangular key cap 1, a key base 3 fastened inside a hole (not shown) on the frame 3 of a keyboard, and a rubber tone 4. The rectangular key cap 1 comprises a downward, hollow, rectangular plunger 11 on the inside. The rectangular plunger 11 comprises four circular rails 12 on the four corners thereof along its length, two fixed, flat wall surfaces 111 on two opposite sides thereof, and two spring plates 112 on the other two opposite sides thereof. The spring plates 112 each have an outside surface 113 curved downwards outwards and terminated into an outward hook 13 respectively. The key base 2 comprises a rectangular guide slot 21 on the top into which the rectangular plunger 11 is inserted, a conical horn gate 23 extended downwards outwards from the rectangular guide slot 21, two hooked portions 22 on the inside at two opposite locations between the rectangular guide slot 21 and the conical horn gate 23 releasably hooked up with the hooks 13 on the two spring plates 112, and a bottom ring 24 disposed below the frame 3. The rectangular guide slot 21 has circular grooves 221 on the four corners thereof on the inside along its length into which the four circular rails 12 of the rectangular plunger 11 fit. The rubber tone 4 is inserted into the conical horn gate 23 inside the key base 3, having a top 41 stopped against the bottom edge of the rectangular plunger 11, a conductor 411 on the inside, a plurality of reinforcing ribs 42 on the inside wall thereof, and a plurality of air vents 44 through the bottom rim 43 thereof.

Figure 5:
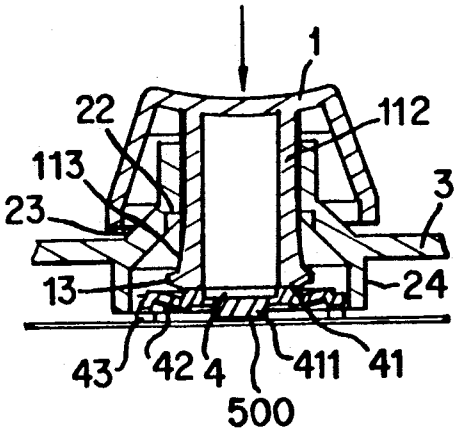
FIGS. 4, 5 and 6 are sectional views of the key switch of FIG. 2 showing its operation.
Figure 4:
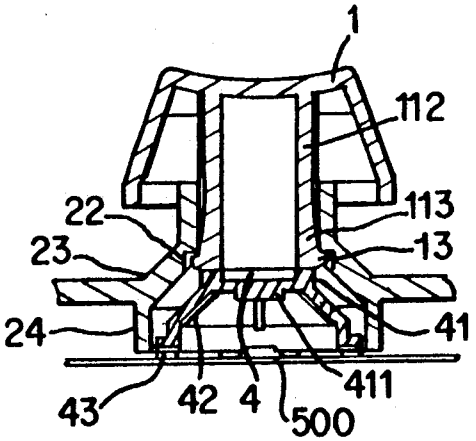
Figure 6:
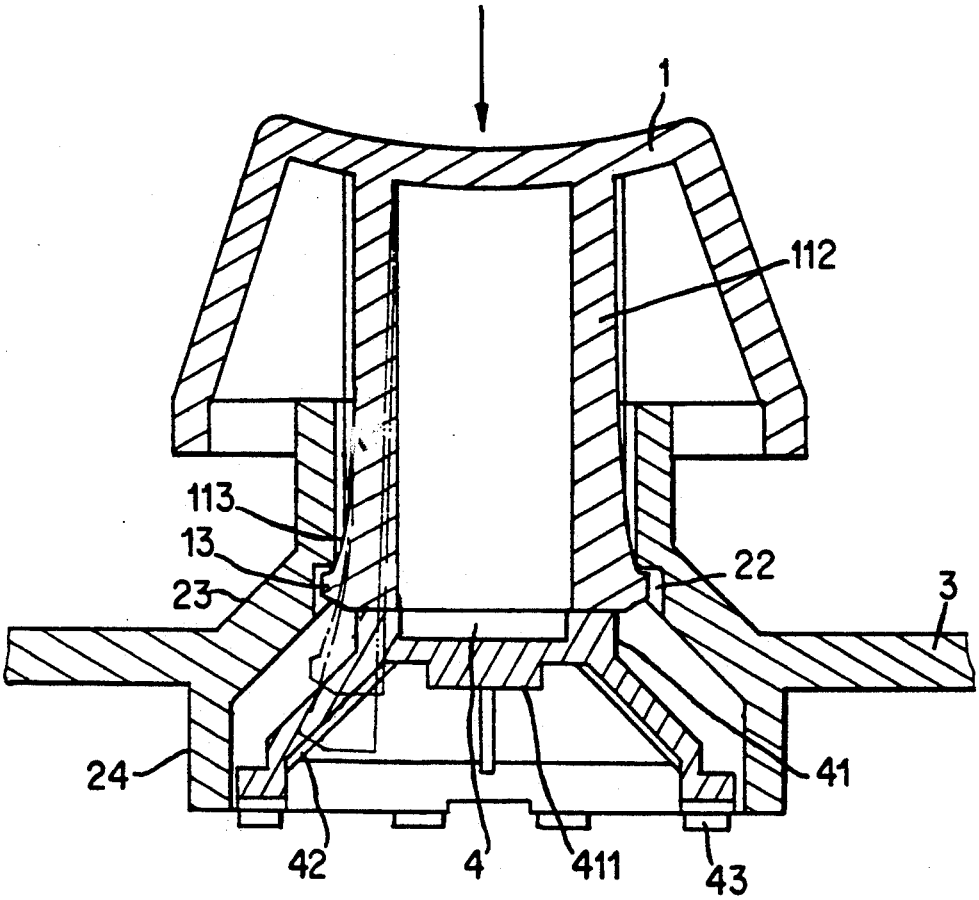

Referring to FIGS. 4, 5 and 6, pressing the key cap 1 causes the rubber tone 4 to be squeezed to deform by the plunger 11. At the same time, compressed air is squeezed to escape from the rubber tone 4 through the air vents 44, and the conductor 411 is moved downward to contact the respective contact 500 on the printed circuit board below in producing a respective pulse signal for transmitting to the computer mainframe. As soon as the rubber tone 4 is released from pressure, outside air is induced into the rubber tone 4 through the air vents 44 causing the top 41 to be returned to its original shape, and therefore the plunger 11 is moved upwards into its original position with the hooks 13 respectively hooked up with the hooked portions 22. As indicated, the circular rails 12 of the rectangular plunger 11 are respectively inserted into the circular grooves on the rectangular guide slot 21. By means of the guidance of the circular grooves, the movement of the rectangular plunger 11 (namely, the key cap 1) is stable. This arrangement also greatly reduces friction resistance during the movement of the rectangular plunger 11 in the rectangular guide slot 21. Furthermore, the arrangement of the curved outside surface 113 on the respective spring plate 112 greatly lessens the noises as the key cap 1 is switched, and simultaneously stabilizes the movement of the rectangular plunger 11 in the key base 3.

Figure 7:
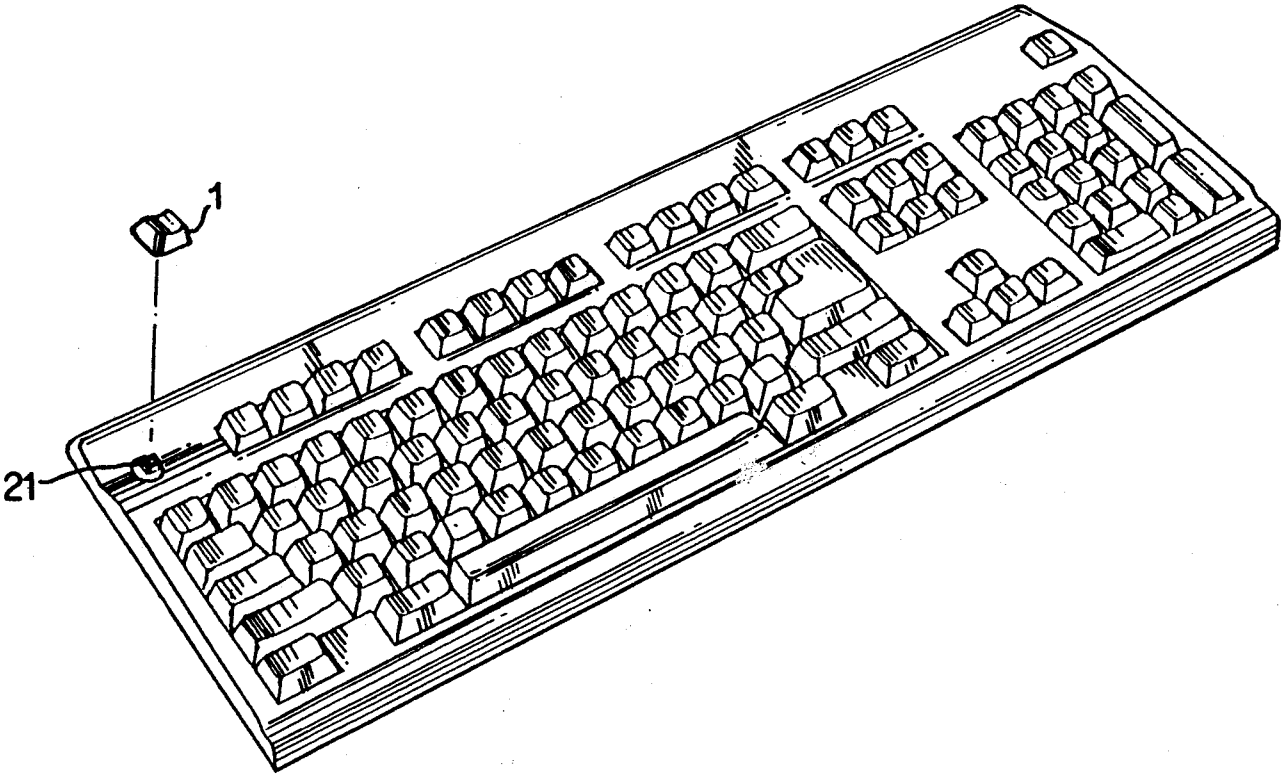
FIG. 7 is an installed example of the present invention in a keyboard.
Figure 8:
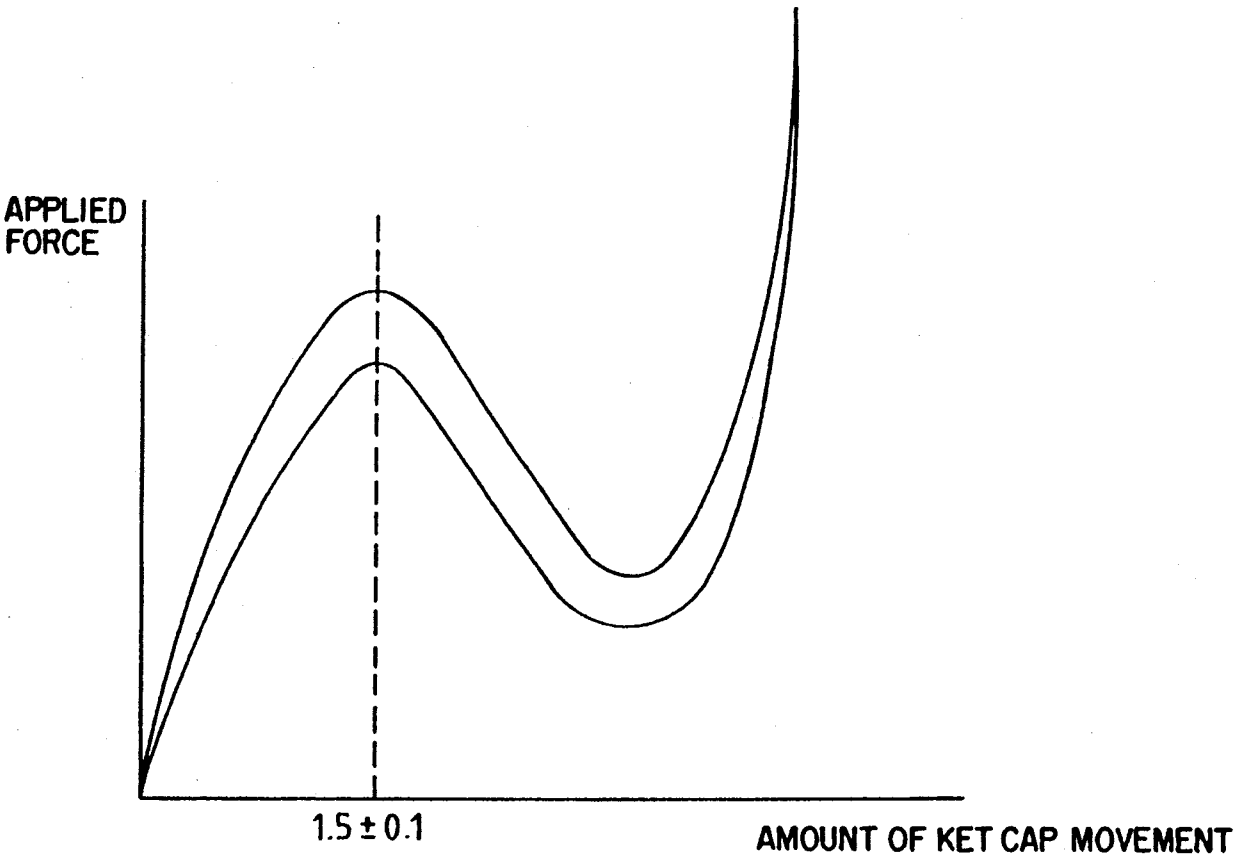
FIG. 8 is a comparison chart between the present invention and the prior art showing the relative relationship between the applied pressure and the amount of key cap movement.

FIG. 7 illustrates an installed example according to the present invention. FIG. 8 illustrates a comparison chart between the present invention and the prior art showing the relative relationship between the applied pressure and the amount of key cap movement, in which the curve on the top is obtained from the prior art, and the curve on the bottom is obtained from the present invention. From FIG. 8, it is apparent that less applied force is required in the present invention to achieve the same amount of key cap movement.

What is claimed is:

1. A keyboard key switch comprising:

a rectangular key cap having an integral, downwardly directed, hollow, rectangular plunger on an inside thereof, said rectangular plunger having four segmented circular rails extending along four respective corners thereof, two fixed, flat wall side walls form two opposite sides of said plunger, and another two opposite sides thereof having two spring plates thereon, each of said spring plates being biased outwardly and terminating in an outwardly opening hook;

a key base adapted to be fastened on a frame of a keyboard, said key base having a rectangular guide slot on a top thereof, said rectangular plunger being received in said slot, a conical horn gate extending downwardly and outwardly from said rectangular guide slot, two hooked slots being formed at opposite locations within said rectangular guide slot in said conical horn gate for releasably receiving the hook on the respective spring plates, and a bottom ring extending downwardly from said conical horn gate, said rectangular guide slot having circular grooves along four corners thereof on an inside into which the four circular segment rails of said rectangular plunger ride; and a compressible rubber tone received in the conical horn gate inside said key base, having a top portion abutting a bottom portion of said rectangular plunger, a conductor located on an inside thereof adapted to contact a contact on a printed circuit board of said keyboard when said key cap is depressed, and a plurality of air vents being formed through a bottom portion thereof.

2. The key switch according to claim 1, wherein said spring plates each have a smoothly curved outside surface adapted to ride along the respective hooked slot on said key base when said cap is depressed.

* * * * *